United States Patent [19]

Ellenberger et al.

[11] 4,157,825

[45] Jun. 12, 1979

[54] DEVICE FOR SEPARATING SINGLE TEXTILE WORKPIECES FROM A STACK

[75] Inventors: Bernd Ellenberger, Gonbach; Wolfgang Seelinger; Gerd Wauer, both of Kaiserslautern, all of Fed. Rep. of Germany

[73] Assignee: Pfaff Industriemaschinen GmbH, Fed. Rep. of Germany

[21] Appl. No.: 858,166

[22] Filed: Dec. 7, 1977

[30] Foreign Application Priority Data

Dec. 17, 1976 [DE] Fed. Rep. of Germany ..... 2657230

[51] Int. Cl.[2] ..... B65H 3/06; B65H 3/56; B65H 5/04

[52] U.S. Cl. ..... 271/10; 414/120; 271/22; 271/160; 271/267

[58] Field of Search ..... 271/18, 18.3, 19, 20, 271/21, 22, 23, 24, 25, 33, 16, 17, 10, 11, 12, 13, 14, 15, 95, 267, 268, 160; 214/8.5 H, 8.5 R

[56] References Cited

U.S. PATENT DOCUMENTS

| | | | |
|---|---|---|---|
| 810,391 | 1/1906 | Bradshaw | 271/25 |
| 3,253,824 | 5/1966 | Southwell et al. | 271/19 |
| 3,940,125 | 2/1976 | Morton | 271/10 |

*Primary Examiner*—Bruce H. Stoner, Jr.
*Attorney, Agent, or Firm*—McGlew and Tuttle

[57] ABSTRACT

A device for separating a topmost workpiece from a stack of textile workpieces, comprises a table support which is guided for upward and downward movement and which is adapted to contain a stack of the workpieces and which is urged in an upward direction by weight means which are engaged with the table. In addition, a holding member is mounted for movement toward and away from the table and includes a lower end which is engageable on the top of the stack to hold the workpieces in position. A strip-off element, for example, a rotatable member having a plurality of radially extending bristles is engageable with the stack adjacent the holding member, and it is rotatable to direct at least the uppermost workpiece over the length of the holding member which is arranged in an inclined position over the stack. The holding member includes holding pins so that as the strip-off member moves upwardly over the holding member, it causes engagement of at least the uppermost workpiece with the pins. The pins are oriented so that the workpieces cannot be removed backwardly in a direction to cause them to fall back into the stack. Since additional workpieces are also likely to be directed up over the holding member, the strip-off member, after it moves to direct at least the uppermost workpiece into engagement with the engagement members along the length of the holding member, then moves in an opposite direction to deflect off any additional workpieces which, by this motion, will become disengaged from the needle and return back to the stack. After the uppermost strip alone is engaged on the holding member, it is raised and positioned in a position to be engaged by a clamping member to move the workpiece into association with an operating machine.

11 Claims, 7 Drawing Figures

9
14
R3
R2
R1
S
W1
W2
W3
W
23

9
S
R2
R3
23
W
W1
W2
W3
17
14
R1
45
48
47
44
36,42

4
5
8
9
10
R1
R2
R3
23
20
19
16
15
17
13
14
S
W1
W2
W3
W

9
R2
R3
23
W
14
R1
S
W1
W2
W3

DEVICE FOR SEPARATING SINGLE TEXTILE WORKPIECES FROM A STACK

FIELD AND BACKGROUND OF THE INVENTION

This invention relates in general to material-handling devices and, in particular, to a new and useful device for separating the topmost workpiece from a stack of textile workpieces, including a holding strip which presses on the stack and a strip-off element cooperating therewith.

DESCRIPTION OF THE PRIOR ART

A separating device for textile workpieces is known from Germant DT-OS No. 2,145,816 and it comprises a vertically movable holder for an adhesive tape with the holder being movable about a horizontal axis. By lowering the adhesive tape holder onto the stack and by subsequently lifting the same, an edge section of the uppermost workpiece is lifted. If the workpieces are strongly felted at the edges, it may then occur that other workpieces are lifted along with the uppermost workpiece. To separate the unintentionally lifted workpieces from the topmost workpiece, a rotating roller, mounted on a holding arm, is pressed against the lifted edge sections which by concomitant pivoting of the adhesive tape holder have been directed obliquely upwardly, due to which, the unintentionally lifted edge sections are stripped-off of the edge section of the uppermost workpiece which is held by the adhesive tape.

A clamping device is actuated after the stripped-off edge sections have fallen back onto the stack, which retains the stack as each separating operation proceeds. At the same time, horizontally and vertically movable suction grips are lowered onto the topmost workpiece. By renewed pivoting of the adhesive tape holder, the edge section of the uppermost workpiece is directed obliquely downward, whereupon, the suction grips pull the workpiece completely off of the stack and the adhesive tape. This separating device is not only relatively expensive, but it also has the disadvantage that the stack is retained only during the pull-off movement of the suction grips, but not during the lifting and subsequent pivoting of the adhesive tape holder. Since by the lifting of the edge section of one or more workpieces and, in particular, by the pivoting of the adhesive tape holder, a horizontal traction is exerted on the portion of the topmost or of or the jointly gripped workpieces still lying on the stack, the stack may be pulled askew or the entire stack is shifted on its base.

Another disadvantage of this device is that the edge sections of the unintentionally gripped workpieces fall back on the stack in an uncontrolled manner after the stripping off by the rotating roller or during automatic detachment from the topmost workpiece caused by gravity. It may then happen that the edge sections fold over, whereupon, these workpieces lie on the stack outside of the region of the clamping device and are seized by the suction grips and pulled off of the stack.

A separating device for textile workpieces is also known from German DT-OS No. 1,460,108, and this device comprises a vertically movable stack table and a lift-off head movable relative to it, with the lift-off head comprising a wedge type holding bar disposed obliquely, and a stripping roll cooperating therewith, which can be reversibly driven. After the lift-off head has been set down on the stack, while the holding bar and the strip-off roll press on the topmost workpiece, the strip-off roll is rotated by a small angular amount in such a way that it forms a fold at the topmost workpiece, wedging the fold into the narrow space between the roll and the holding bar. In this way, the uppermost workpiece is firmly connected with the lift-off head and is lifted off of the stack when the head then moves upwardly. After removal of the workpiece from the stack, the strip-off roll is rotated by the same angle as before, but in the opposite direction, and in view of this, the workpiece is released and drops from the lift-off head.

Since in this separating device, the workpiece may be seized anywhere, not necessarily in the region of an edge, the stack cna be aligned relative to the lift-off head so that the workpieces are seized substantially in their center. In this case, there are no forces acting unilaterally on the stack as a workpiece is being pulled off, so that a stack remains aligned in vertical direction even if it is not clamped. However, this advantage is offset by the disadvantage that such workpieces, gripped in the center and therefore hanging down in folds, must generally be spread out and straightened before they can be treated further. Another disadvantage is that, if the workpieces adhere strongly together, the strip-off roll will form a fold not only on the topmost workpiece, but also on the next, and possibly even the second next workpiece, again wedging the fold into the space between the roll and the holding bar. Even if a fold is formed only at the uppermost workpiece and wedged between the roll and holding bar, it may happen, if the workpieces adhere strongly together, that during the lifting together with the uppermost workpiece, they are partially or completely removed from the stack. In addition, this principle of workpiece separation is unsuitable for workpieces comprising materials which crease easily, as the fold formed by the cooperation of the strip-off roll and holding bar remains after the workpiece is released and can thus be eliminated only by ironing.

SUMMARY OF THE INVENTION

The present invention provides a separating device for separating the topmost workpiece from a stack of workpieces which is of a comparatively simple design and which operates so that only one workpiece is always lifted off of the stack with the stack being secured against slipping during the entire separating process.

The invention provides a device wherein a strip-off element is movable in opposite directions to take up the topmost workpiece and to bring back the workpieces seized along with it, while the holding bar rests on the topmost workpiece and, wherein, the holding bar is provided with holding means for the topmost workpiece and is movable relative to the strip-off element.

At the start of the separating process, the strip-off element, preferably acting on the stack in the edge region of the topmost workpiece, executes a relative movement in the direction of the holding bar at least at the point of contact with the workpiece, whereby, the edge section of the topmost workpiece is placed on the plane of the holding bar turned toward the strip-off elements, or it is opened up like a leaf. If the workpieces adhere together, e.g., due to felting at the edges, it may happen, however, that the strip-off element places on the holding bar not only the edge section of the topmost workpiece, but jointly therewith also the edge sections of additional workpieces. Because of the measure according to the invention to construct the holding bar, with the aid of the holding means, as an automatically acting holding element which is able to retain a workpiece without assistance from the strip-off element, the strip-off element can execute, immediately after completion of the first relative movement, a second relative movement in an opposite direction, in a manner according to the invention, whereby, it strips off the unintentionally siezed edge sections from the edge section of the topmost workpiece retained by the holding means and places them back on the stack spread out flat. Thereafter, by raising the holding bar, the topmost workpiece can be removed from the stack completely.

According to a further proposal of the invention, the strip-off element rests on the stack while the holding bar moves relatively to it. The stack is thus immobilized during the entire separating process, namely, during the movements of the strop-off elements by the holding bar, and during the movement of the holding bar by the strip-off element. In this manner, the stack is secured against shifting or pulling askew without additional clamping or supporting means.

According to a further proposal of the invention, the strip-off element is movable substantially parallel to the receiving plane of the holding bar formed by the holding means. While in many cases it would be sufficient if the strip-off element were formed by a roll adjustable in its spacing from the holding bar, a more reliable operational result is obtained if, according to the invention, the strip-off element executes a movement parallel to the holding bar, either exclusively or in addition to said rotary movement. In this case, the strip-off element is able to press the edge section of the topmost workpiece uniformly firmly at every point of the holding means of the holding bar, so that this edge section is reliably retained during the return movement of the strip-off element.

In a strip-off element which executes rotary movements, due to the air flow on the periphery thereof, in the region between the strip-off element and the topmost workpiece of the stack, a suction effect occurs, whereby, the stripping efffect of the strop-off element is supported, Because of this, at the beginning of a separating process, the strip-off element may be arranged a little higher than the holding bar, owing to which, it presses on the stack less strongly than the holding bar. In this manner, the strip-off element does not touch the next following workpiece after the edge section of the topmost workpiece has been stripped off, thereby, counteracting the tendency of stripping-off additional workpieces from the stack, besides the edge section of the topmost workpiece. With proper design of the strip-off element, so strong an air flow, or so effective a suction effect, can be achieved, that for only slightly cohering workpieces which are therefore easy to separate from each other, the strip-off element is able to strip the edge section of the topmost workpiece off of the stack without direct contact.

According to a further proposition of the invention, the holding means is formed by needles extending obliquely to the holding bar, at least at their free end, counter to the direction of the return movement of the strip-off element. During the first relative movement of the strip-off element, extending in the direction of the holding bar and, hence, in the direction of slant of the needles, the strip-off element can pull the edge section of the topmost workpiece over the points of the needles as it is being placed on the holding bar, possible unhindered, so that the edge section of the workpiece is sure to be spread out flat on the holding bar. Only after the direction of movement of the strip-off element is reversed and the latter now moves during its second relative movement counter to the slant of the needles, the points of the needles prick into the edge section of the topmost workpiece and thereby prevent the edge section from being pulled off of the holding bar. By providing a large number of needles and by appropriate desing, the points of the needles can penetrate into a workpiece by only a small amount, so that even in thin workpieces, only the edge section of the topmost workpiece is always retained.

According to another feature of the invention, the holding bar is provided with recesses and is movable obliquely upwardly into the region of a pull-off device engaging into the recess. The obliquely upwardly directed movement of the holding bar offers the advantage, compared with a movement in a vertical direction only, that the topmost workpiece is peeled off of the stack, substantially flat, whereby, the workpiece which follows next, which is retained by the strip-off element in the edge region, is only lifted slightly and, therefore, it falls back flat onto the stack. As soon as the pull-off device, which may be designed, for example, in the form of pliers, seizes the edge section of the workpiece in the recesses of the holding bar, the pull-off device can, by a substantially horizontal movemnt, detach first the edge section of the workpiece from the needles and then pull the entire workpiece over the needles unhindered and supply it to a processing machine, e.g., a sewing machine.

Because of the great compressibility of a high stack of textile workpieces and the comparatively small compressibility of a low stack of equal workpieces, dissimilar operating conditions would result at constant pressing force between the stack on the one hand and the strip-off element and the holding bar, on the other. To eliminate the effect of the stack height on the operational result of the separating device, it is further proposed by the invention that a stack table carrying the stack is connected with a drive device which exerts a small pressing force when the distance from the strip-off element and from the holding bar is great, and a greater force when the distance is smaller.

According to a further feature of the invention, the stack table is connected with a pull weight through at least one eccentric type rotatable transmission means. The eccentric type transmission means is designed and arranged so that the radius effective in relation to the pull weight is small when the stack is high and becomes increasingly greater as the stack becomes lower, whereby, the torque generated by the pull weight and the transmission means and causing the lifting of the stack table becomes greater with diminishing stack height.

Accordingly, it is an object of the invention to provide a device for separating a topmost workpiece from a stack of textile workpieces which comprises a holding member having a workpiece engagement means along its length and a lower end engageable on the top of the stack to hold the workpieces in position and further including a strip-off element which s engageable with the top of the stack at a location adjacent the holding member to direct at least the topmost workpiece onto the holding member in interengagement with the engagement means and to progressively distribute the width of the workpiece from the location of its engagement by the lower end of the holding member to its opposite edge over the length of the holding member and, wherein, the engagement means prevents disengagement of the topmost workpiece picked up in a direction to permit the topmost workpiece to fall back into the stack and, wherein, the strip-off element is moved in an opposite direction over the workpieces which are picked up to disengage any additional workpieces which have been picked up with the uppermost workpiece.

A further object of the invention is to provide a device for separating a topmost workpiece from a stack of textile workpieces which is simple in design, rugged in construction and economical to manufacture.

The various features of novelty which characterize the invention are pointed out with paticularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
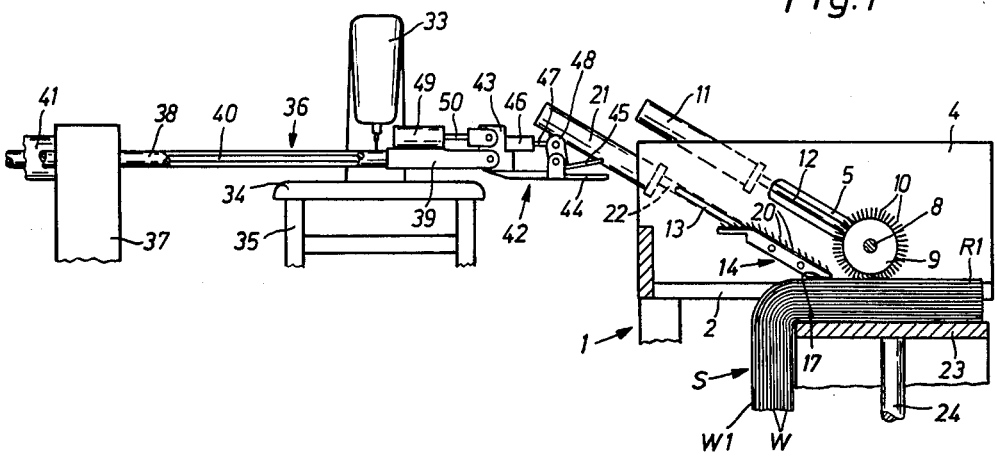
FIG. 1 is a partial sectional and partial side elevational view of a device for separating workpieces from a stack of workpieces, constructed in accordance with the invention.

Referring to the drawings in particular, the invention embodied therein, comprises a device for separating the topmost workpiece W1 from a stack S of workpieces W which are positioned on a stack table 23 alongside an operating machine, plates 4. A longitudinally displaceable, non-rotating slide piece 6 is arranged in each of the two guide slots 5. One of the slide pieces 6 has a gear motor 7 flanged to it, operating in one or the other direction of rotation, which is self-braking in the switched off state and which drives a shaft 8 which, in turn, is mounted in the two slide pieces 6.

Shaft 8 carries a strip-off roll 9 which has a large number of radially directed bristles 10 on its periphery. Strips or loops of leather or rubber, for example, may be arranged therein instead of bristles 10. The entire roll may also be made of a foam rubber. another possibility would be to arrange several of the materials named alternately side-by-side by sections. The common objective of these different design possibilities is to create an elastically deformable strip-off element with a gripping surface which is able to retain the stack when the holding bar is lifted. A compressed air cylinder 11, aligned parallel to the guide slot 5, is secured on each of the two bearing plates 4, with its piston rod 12 being connected with the associated slide piece 6.

Figure 4:
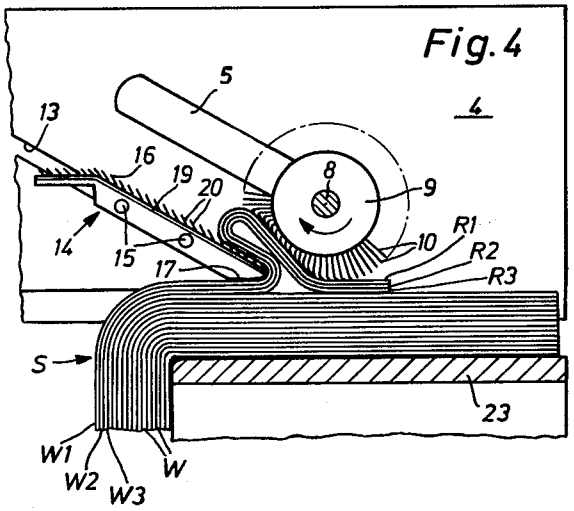
FIG. 4 is an enlarged side elevational view of the device shown in an initial stage of operation of the strip-off and holding members.

A guide slot 13 is provided below the guide slot 5 and parallel thereto in each bearing plate 4. An obliquely extending holding bar 14 is arranged between the two bearing plates 4, and it is mounted by two laterally fastened guide pins 15 in each of the guide slots 13 (FIG. 4). A horizontally extending pressure plane 17 is formed at the lower end of the holding bar 14, in a wedge type design. The upper end of the holding bar 14 is bent horizontally and has several recesses 18. On the side toward the strip-off roll 9 and on the bent upper end of the holding bar 14, a needle band 19 is fastened, whose needles 20 are directed counter to the direction of the return movement of the strip-off roll 9 obliquely to the respective surfaces of the holding bar 14 and form receiving surface 16 for an edge section R1 of the uppermost workiece W1 of a stack of workpieces W. A compressed air cylinder 21 aligned parallel to the guide slot 13 is fastened on each of the two bearing plates 4, whose piston rod 22 is connected with the two guide pins 15 protruding from the respective guide slot 13.

Figure 3:
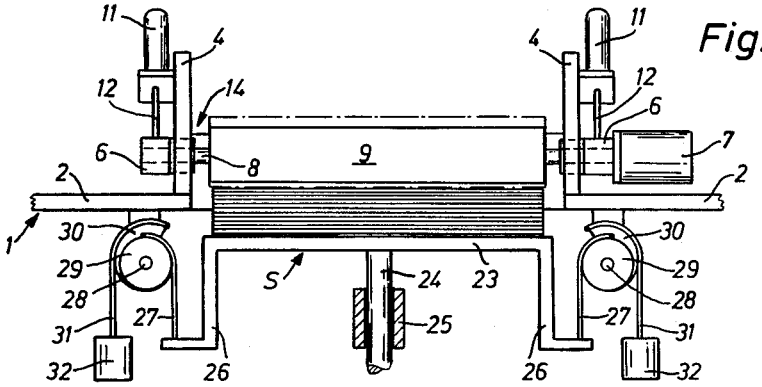
FIG. 3 is a transverse sectional view showing the operation of the stack table.

A stack table 23 is disposed below the table plate 2, in the region of the recess 3, which is guided vertically by means of a guide rod 24 secured on the underside in a bushing 25 (FIG. 3) secured on frame 1, in a manner which has not been shown. The stack table 23 has an outwardly bent attachment collar 26 on each of two opposite sides. One end of a cable 27 is fastened at each attachment collar 26, whose other end is fastened to the circumference of a cable drum 29 mounted in frame 1 on a stud 28. Further, an eccentrically disposed pulley 30 is mounted on each stud 28 which is non-rotationally connected with the associated drum 29. One end of a cable 31 is fastened on the circumference of pulley 30, whose other end is connected with a pull weight 32. Part 27 to 32 form a drive device for the stack table 23.

Figure 2:
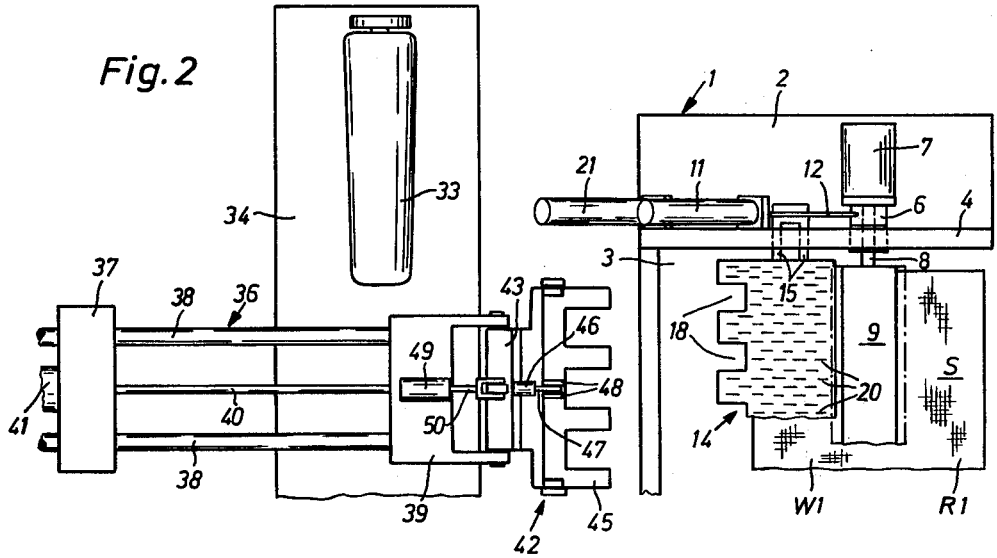
FIG. 2 is a top plan view of the device shown in FIG. 1.

According to FIGS. 1 and 2, the separating device is set up in front of a sewing machine 33 which is secured on the table plate 34 of a machine frame 35.

A pull-off device 36 is associated with the separating device. The pull-off device 36 comprises a pedestal 37 in which two parallel guide rods 38 are slidably mounted. A fork-type support plate 39 which is connected with the piston rod 40 of a compressed air cylinder 41 secured on the pedestal 37 is fastened to the guide rods 38. A clamp 42 consisting of a support block 43, a lower clamp plate 44 secured thereon, and an upper clamp plate 45 pivotably mounted on the clamp plate 44 is pivotably mounted on the support plate 39. At the support block 43, a compressed air cylinder 46 is arranged, whose piston rod 47 is connected with lugs 48 of the upper clamp plate 45. A compressed air cylinder 49 is arranged on support plate 39, whose piston rod 50 is articulated to the support block 43. The claim plates 44, 45 are designed in rake form in such a way that the projecting parts of the clamping plates 44, 45 can engage in the recesses 18 of the holding bar 14.

The operation of the device is as follows:

The stack S of textile workpieces W lying on the stack table 23 is pressed by means of the pull weights 32, from below, against the strip-off roll 9 and the holding bar 14, which both are in the lower end position shown in FIG. 1. In this position, the pressure plane 17 of the holding bar 14 lies lower than the ends of the downwardly directed bristles 10, so that the holding bar 14 forms a stop which limits the upward movement of the stack table 23. In so doing, the stack S is compressed in the region of the holding bar 14 to the extent that the bristles 10 also come into contact with stack S, but with a much smaller pressing force than the holding bar 14.

The stack S is arranged on the stack table 23 so that the strip-off roll 9 and the holding bar 14 press onto an edge section R1 of the topmost workpiece W1, the ridge of the edge section R1 being located on the side of the roll 9 opposite the holding bar 14. At the beginning of a separating process, the gear motor 7 is switched on, so that roll 9 rotates clockwise, as seen in FIG. 4. In so doing, roll 9 executes a relative movement in the direction of the holding bar 14 at the contact point with the edge section R1 of the topmost workpiece W1.

For the separating process here described, it is assumed that due to the strong felting at the edges, the workpieces W, forming the stack S, tend to ahere together. For this reason, the strip-off roll 9 strips off from stack S, (FIG. 4), not only the edge section R1, but also the adhering edge sections R2 and R3 of the workpieces W2 and W3 lying under the topmost workpiece W1 and places them like leaves on the needles 20 of the holding bar 14. Simultaneously with, or a short time after the switching on of the gear motor 7, the strip-off roll 9 is pushed by the two compressed air cylinders 11 along the holding bar 14 into the upper end position, whereby, the edge sections R1, R2 and R3, placed on the needles 20 due to the rotations of roll 9, are pressed on. By a sufficiently large number of needles 20 and by an adequate form of these needle 20, it is achieved that with the pressing-on of the edge sections R1, R2 and R3, the points of the needles 20 can penetrate into the edge section R1 of the topmost workpiece W1 by only a small measure, even if the workpieces W are thin.

Figure 5:
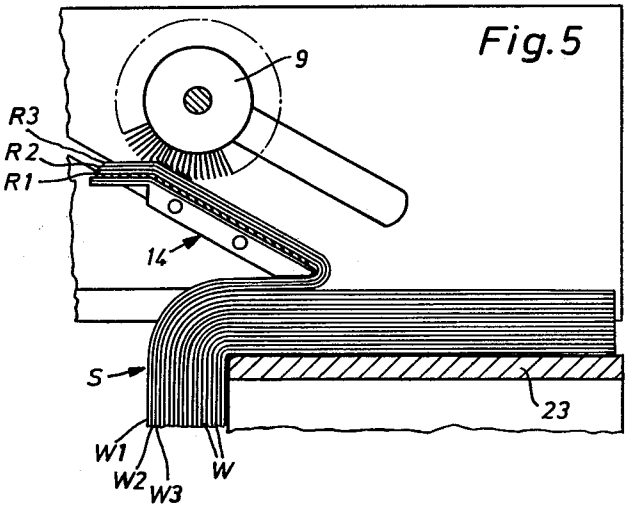
FIGS. 5, 6 and 7 are views, similar to FIG. 4, showing advanced positions of operations of the various parts.
Figure 6:
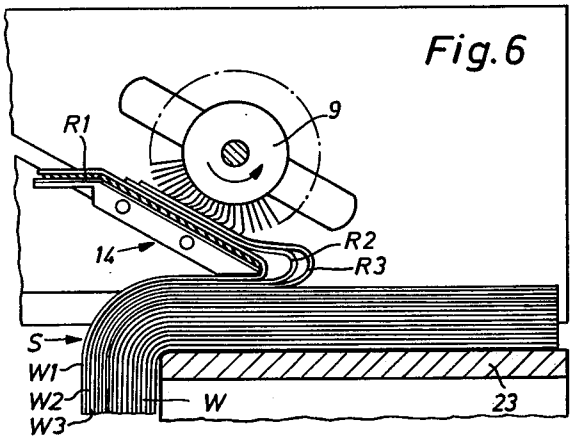

As soon as the strip-off roll 9 has reached the upper end position shown in FIG. 5, the gear motor 7 is switched over, so that its direction of rotation is reversed. At the same time, the strip-off roll 9 is pushed back by the two compressed air cylinders 11 along the holding bar 14 into the lower end position. As shown in FIG. 6, in the course of these coincident rotary and sliding movements of roll 9, the two edge sections R2 and R3 are stripped off of edge section R1, which is retained by the needles 20 slanting upwardly. After the edge sections are stripped off, they fall back onto stack S, spread out flat.

Figure 7:
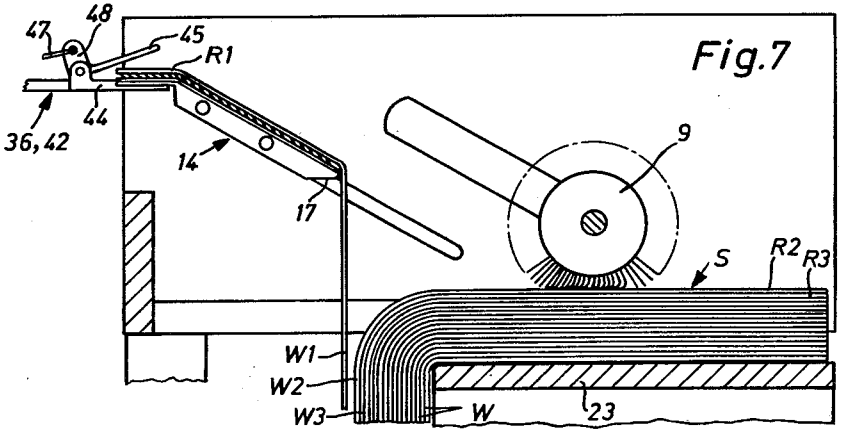

As soon as roll 9 has reached the lower end position, the gear motor 7 is switched off. Thereafter, the holding bar 14 is pushed by the two compressed air cylinders 21 into the upper end position shown in FIG. 7, workpiece W1 being peeled off of workpiece W2 or off of the stack S. Simultaneously with the lifting of the holding bar 14, by means of the pull weights 32, stack S is pressed more strongly against the stationary and non-rotational strip-off roll 9 which, now acting as a stop, limits the upward movement of the stack table 23 and, in so doing, secures stack S against slipping.

After the holding bar 14 has reached the upper end position, the opened clamp 42 is pushed by the compressed air cylinder 41 into the righthand end position according to FIGS. 1 and 2, in which, by compressed air cylinder 46, the upper clamping plate 45 is pivoted downwardly and the edge section R1 is seized by the clamping plates 44, 45 in the region of the recesses 18. Thereafter, by means of the compressed air cylinder 41, clamp 42 is displaced in the direction of the sewing machine 33 and, thereby, workpiece W1 is pulled off of the holding bar 14. Since the needles 20 are directed obliquely in the direction of this pull-off movement, the edge section R1 can become easily detached from the needles 20, and workpiece W1 can slide over the points of the needles 20 unhindered.

In the course of the pull-off movement, edge section R1 of workpiece W1 is pulled onto the table plate 34 and finally into the region of the stitch-forming point of the sewing machine 33. As soon as the sewing and transport tools (not shown) of the sewing machine 33 have seized the edge section R1, clamp 42 is opened by means by means of the compressed air cylinder 46 and, after the previously retained portion of the edge section R1 has fallen onto the table plate 34, clamp 42 is pivoted up by means of the compressed air cylinder 49 so that, during the subsequent sewing process, the workpiece W1 can run through under the clamp 42 unhindered.

After the pull-off device 36 has pulled the workpiece W1 off of the holding bar 14, holding bar 14 is brought back by the compressed air cylinders 21 into the lower end position for execution of the next separating process and stack S is again moved downwardly by a small amount with the stack table 23, with the result that the strip-off roll 9 presses on stack S again with less force. At the same time, the opened and lifted clamp 42 is moved back in the direction of the separating device so that it can seize workpiece W2 immediately after termination of the next separating process.

The operations of separating, sewing and the return of the opened clamp 42 overlap in time and, thereby, achieve a continuous work sequence and a faborable utilization of the machine. If edge-parallel seams must be formed on the workpieces, before the sewing machine 33, a known contour control apparatus may be arranged, which brings about an automatic side alignment of the workpieces. In this case, the sewing setup consisting of the sewing machine 33, the separating device an the pull-off device 36 can operate fully automatically, with the workpieces treated on the sewing machine 33 being taken over, for example, by a stacking device, which has not been shown.

If workpieces exclusively of air-impermeable material are to be separated, it may be desirable to retain the workpieces on the holding bar 14 by suction air rather than by the needles 20.

It may further be desirable to bend the lower portion of the guide slots 13 angularly downward, so that when being set down on the stack S, the pressure plane 17 of the holding bar 14 executes a vertical movement exclusively. In this case, the holding bar 14 executes a vertical pressing force during the setting down on stack S, by which the stack is retained on the stack table 23 and cannot slip to the side.

Another possibility of removing a workpiece retained by the needles 20 of holding bar 14 and peeled off of stack S from the holding bar 14, is to design the retention and the drive of the holding bar 14 so that, in the end position away from the stack S, it executes a 180° rotation about a horizontal axis, whereupon, the workpiece slips off of the now downwardly directed needles 20 by gravity and falls, for example, onto a conveyor belt or directly onto the table plate 34.

What is claimed is:

1. A device for separating a topmost workpiece form a stack of textile workpieces, comprising a holding member having a lower end engageable on the top of the stack to hold the workpieces in position, said holding member having end elongated surface, workpiece engagement means distributed along said surface, a strip-off element engageable with the top of said stack adjacent said holding member, movement means connected to said strip-off element to move said strip-off element into engagement with the top of said stack to direct at least the topmost workpiece onto the holding member and into engagement with said engagement means by movement in a first direction to progressively direct the width of the workpiece from the location of its engagement by said lower end of the holding member up to its opposite edge by directing this length of workpiece over the length of said surface, said workpiece engagement means preventing disengagement of the topmost workpiece picked up in a direction which would permit the falling of this workpiece back into the stack, means for moving said strip-off element in a second direction opposite to the first direction over said surface and said workpieces to disengage any additional workpieces which have been picked up with said uppermost workpiece from said surface, and means for moving said holding member upwardly to lift the uppermost workpiece off of the stack.

2. A device as claimed in claim 1, wherein said strip-off element is moved into engagement with the stack to hold the stack in position as said holding member is moved upwardly off of said stack with the uppermost workpiece.

3. A device as claimed in claim 1, wherein said strip-off element is movable parallel to said surface of said holding element.

4. A device as claimed in claim 1, wherein said workpiece engagement means comprises a plurality of needles distributed over the surface of said holding member which are oriented at an angle sloping in a direction opposite to the second direction.

5. A device as claimed in claim 1, wherein said holding member has an edge with a plurality of spaced recesses therealong and a pull-off device arranged adjacent said holding member at the upper position of its movement engageable into said recesses.

6. A device as claimed in claim 1, including a support table for the stack of workpieces, means mounting said support table for upward and downward movement and means for biasing said work table upwardly toward said strip-off element.

7. A device as claimed in claim 6, wherein said means biasing said stack table upwardly comprises a weight connected to said stack table urging it in an upward direction.

8. A device as claimed in claim 1, wherein said strip-off element comprises a rotary member.

9. A device as claimed in claim 1, including a vertical support wall adjacent said stack having first and second parallel guide slots, first means carrying said holding member guided in said first slot and second means carrying said strip-off element guided in said second slot and means connected to said first and second means for moving it backwardly and forwardly in said slots.

10. A device as claimed in claim 1, including a pull-off member comprising a clamp member, means for opening and closing said clamp member, said holding member being liftable to present the upper edge of the uppermost workpiece adjacent said clamp member, and means for closing said clamp member to engage the workpiece.

11. A device as claimed in claim 10, wherein said clamp member includes a clamping jaw having a plurality of spaced projecting portions, said holding member having a substantially horizontal upper portion with spaced apart recesses engageable by said projections of said clamping member.

* * * * *